US009557135B2

(12) United States Patent
Liang

(10) Patent No.: US 9,557,135 B2
(45) Date of Patent: Jan. 31, 2017

(54) WATER GUN

(71) Applicant: DONGGUAN TIGER POINT METAL & PLASTIC PRODUCTS CO., LTD., Dongguan, Guang Dong Prov. (CN)

(72) Inventor: Fa-Kuang Liang, Taipei (TW)

(73) Assignee: DONGGUAN TIGER POINT METAL & PLASTIC PRODUCTS CO., LTD., Dongguan, Guang Dong Province (CN)

( * ) Notice: Subject to any disclaimer, the term of this patent is extended or adjusted under 35 U.S.C. 154(b) by 0 days.

(21) Appl. No.: 14/720,064

(22) Filed: May 22, 2015

(65) Prior Publication Data

US 2016/0341515 A1 Nov. 24, 2016

(51) Int. Cl.
*F41B 9/00* (2006.01)

(52) U.S. Cl.
CPC ..... *F41B 9/004* (2013.01)

(58) Field of Classification Search
CPC ..... B05B 11/0048; B05B 11/0051; B05B 11/0056; F16N 3/12; F41B 9/004; F41B 9/0037; A62C 13/003
See application file for complete search history.

(56) References Cited

U.S. PATENT DOCUMENTS

| | | | | |
|---|---|---|---|---|
| 1,971,450 | A * | 8/1934 | Heitmulier | A62C 13/003 169/33 |
| 4,733,799 | A * | 3/1988 | Wiskur | F41B 9/0037 124/65 |
| 7,913,880 | B2 * | 3/2011 | Chia | A63H 23/10 222/386 |
| 2006/0200081 | A1 * | 9/2006 | Mizus | A61M 25/0021 604/164.05 |

* cited by examiner

*Primary Examiner* — Frederick C Nicolas
*Assistant Examiner* — Bob Zadeh
(74) *Attorney, Agent, or Firm* — Muncy, Geissler, Olds & Lowe, P.C.

(57) ABSTRACT

A water gun is revealed. The water gun includes a jetting outlet and at least one suction inlet. The jetting outlet is disposed on a front plate of a barrel of the water gun while the suction inlet that works like a one-way valve is arranged around the jetting outlet. When the hand grip is pulled out, water outside is drawn into an inner space of the barrel of the water gun through the at least one suction inlet. The water in the inner space of the barrel of the water glue is unable to flow out through the at least one suction inlet when the hand grip is pushed in. Moreover, an inner thread is arranged outside the jetting outlet and used for connecting a ball inflating needle or a bike pump hose for inflation of inflatable toys or balls.

5 Claims, 7 Drawing Sheets

WATER GUN

BACKGROUND OF THE INVENTION

The present invention relates to a water gun for children to play with, especially to a water gun disposed with a jetting outlet and at least one suction inlet for providing functions of rapid water suction and inflation.

Generally, a water inlet and a water outlet of water guns available on the market now are located at the same hole having a diameter ranging from 4 to 8 centimeters. Although the water gun has the simple structure, it is unable to suck water rapidly and spray water far away for a long time. In order to suck water quickly, the diameter of the water inlet should be increased. The larger the diameter of the water inlet, the shorter the water shooting distance and the shooting time. If the user wants a further shooting distance for a longer time, the diameter of the water outlet should be smaller. But the water suction speed is lowered and the suction time is increased. The design doesn't match user's requirements for water guns. The conventional water gun is used less efficiently due to two opposite functions including water shooting and water suction performed through the same hole. There is room for improvement and a need to provide a water gun with novel structure.

SUMMARY OF THE INVENTION

Therefore it is a primary object of the present invention to provide a water gun that sucks water rapidly, having much more fun and uses as an inflation tool.

In order to achieve the above object, a front plate of a water gun is disposed with at least one suction inlet and a jetting outlet for water suction and water shooting respectively. The suction inlet is disposed around the jetting outlet, and having a larger diameter or area than that of the jetting outlet. Thus the water is drawn into the water fun more rapidly. Moreover, the suction inlet works like a one-way valve so that water is only able to enter the water gun, without being discharged. The jetting outlet has a smaller diameter compared with the diameter of the suction inlet. Thus users can shoot water over a greater distance and for a longer time. Thereby the water gun is used more efficiently and having more fun.

A threaded insert is disposed just outside the jetting outlet. The threaded insert can be mounted with a ball inflating needle for inflation of inflatable toys or balls. Or the threaded insert is connected to a bike pump hose for inflation of bicycle tires.

DETAILED DESCRIPTION OF THE PREFERRED EMBODIMENT

Figure 1:
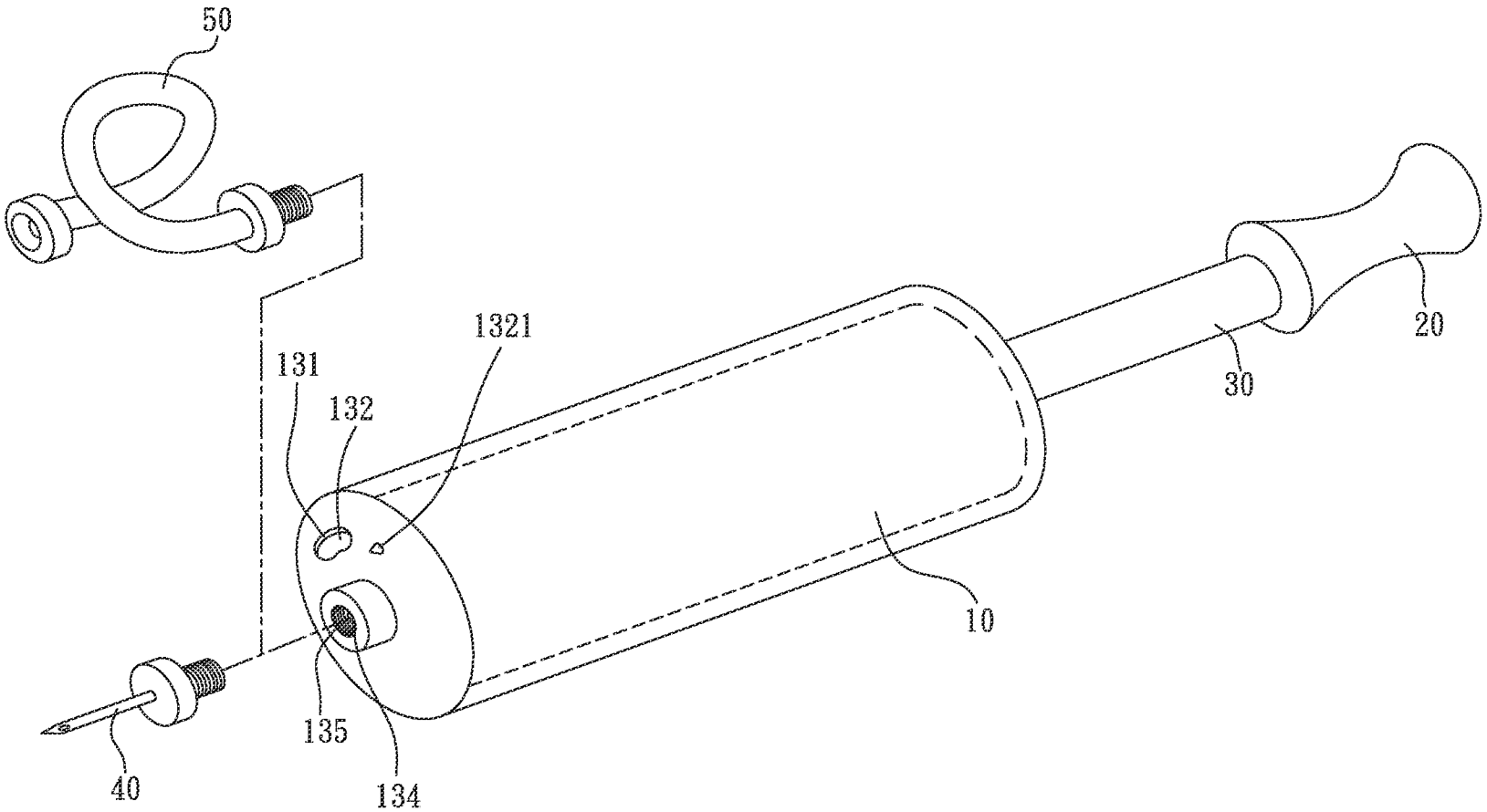
FIG. 1 is a perspective view of an embodiment according to the present invention.
Figure 2:
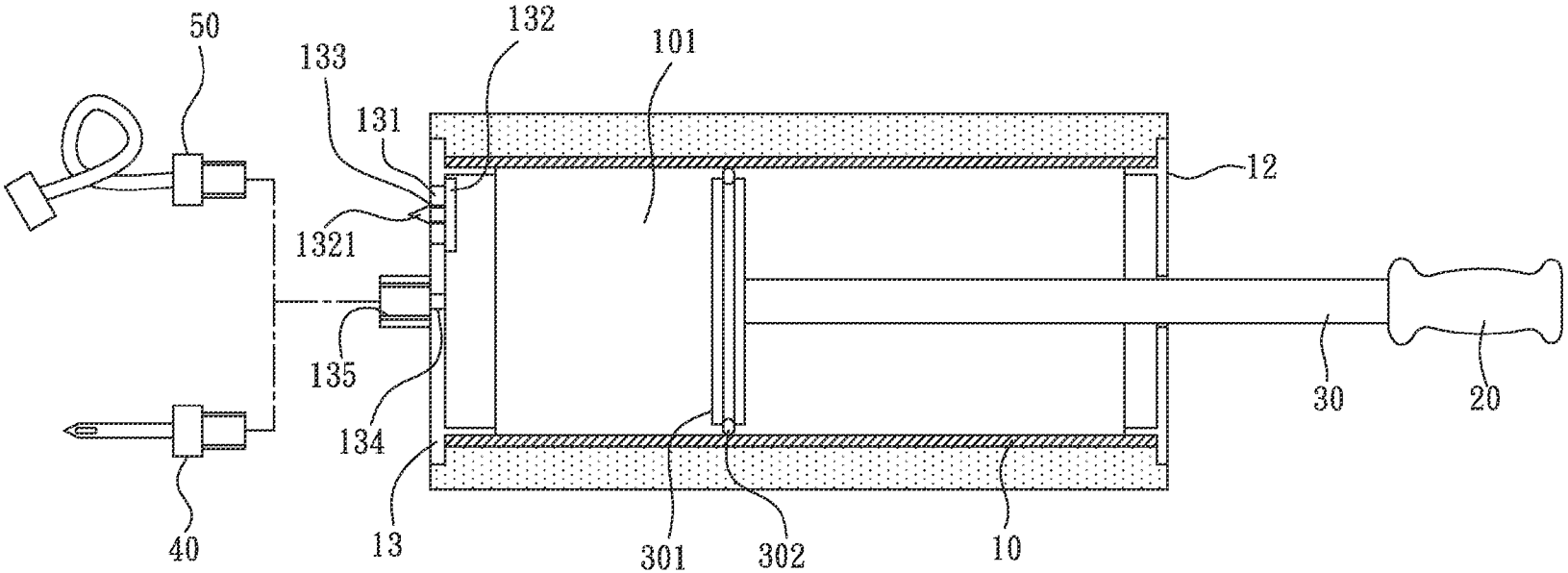
FIG. 2 is a cross sectional view of an embodiment according to the present invention.
Figure 6:
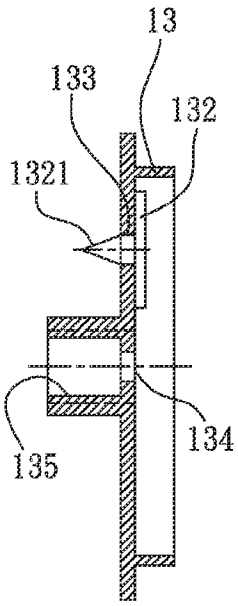
FIG. 6 is a cross sectional view taken along line B-B of the embodiment in FIG. 5 according to the present invention.
Figure 5:
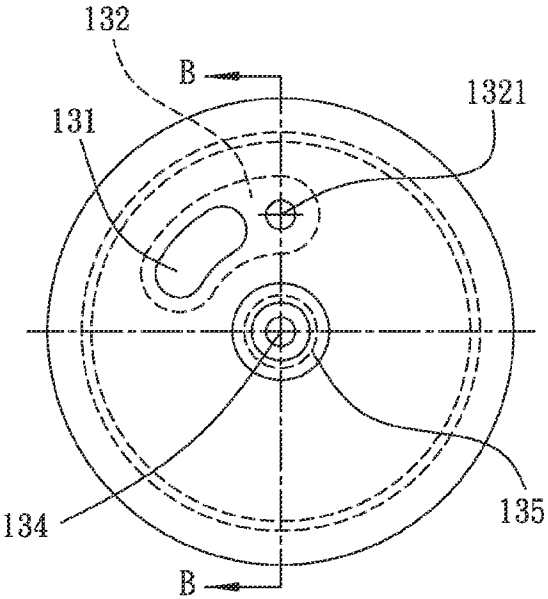
FIG. 5 is a front view of a front plate without being arranged with a non-return valve of an embodiment according to the present invention.
Figure 4:
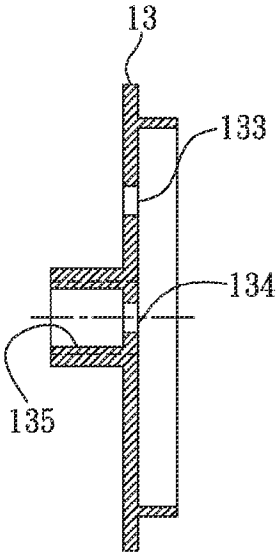
FIG. 4 is a cross sectional view taken along line A-A of the embodiment in FIG. 3 according to the present invention.
Figure 3:
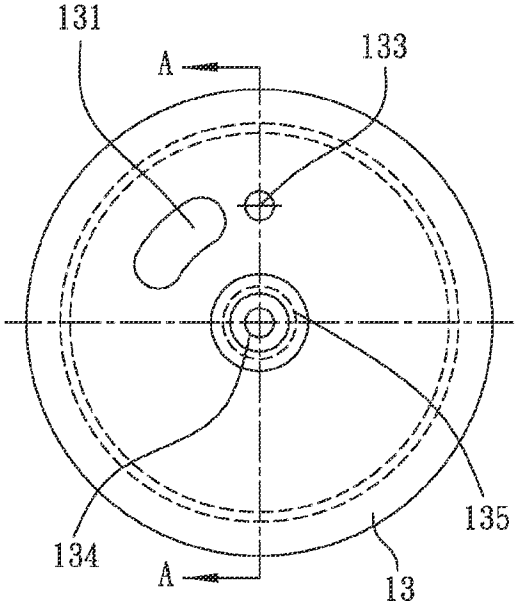
FIG. 3 is a front view of a front plate without being disposed with a non-return valve of an embodiment according to the present invention.

Refer to FIG. 1 and FIG. 2, a water gun of the present invention includes a barrel 10, a shaft 30, and a hand grip 20 disposed on a rear end of the shaft 30. The barrel 10 is formed by a front plate 13 and a rear plate 12. The shaft 30 is passed through a center of the rear plate 12 of the water gun. A cylinder valve 301 is disposed on a front end of the shaft 30 and is integrated with the shaft 30. A circular groove for receiving a rubber ring 302 is arranged around the cylinder valve 301. Thus the cylinder valve 301 is slideable and airtightly fit in the barrel 10.

Figure 9:
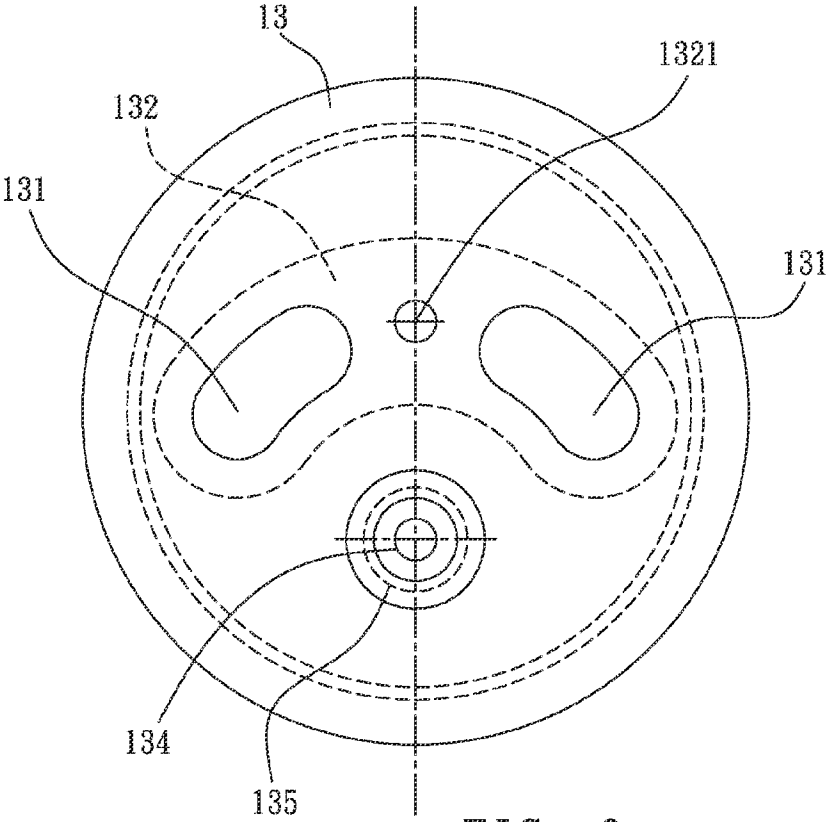
FIG. 9 is a front view of a front plate of another embodiment according to the present invention.
Figure 11:
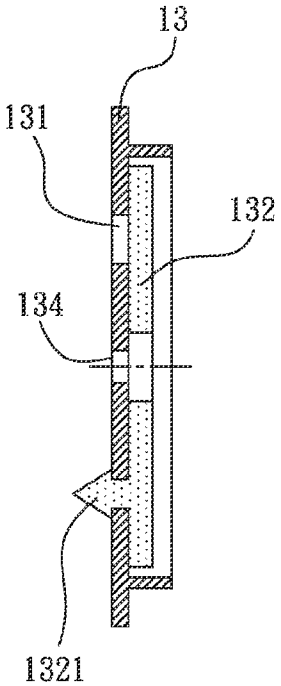
FIG. 11 is a cross sectional view taken along line C-C of the embodiment in FIG. 10 according to the present invention.
Figure 10:
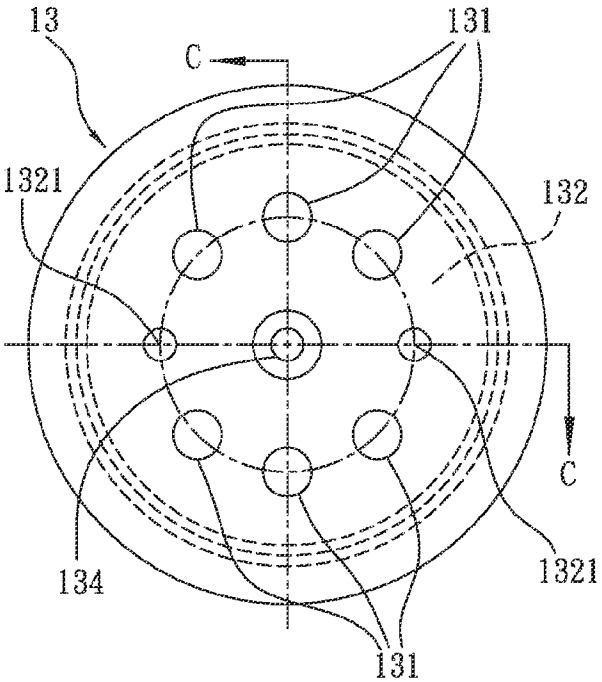
FIG. 10 is a front view of a front plate without being disposed with a thread of another embodiment according to the present invention.
Figure 13:
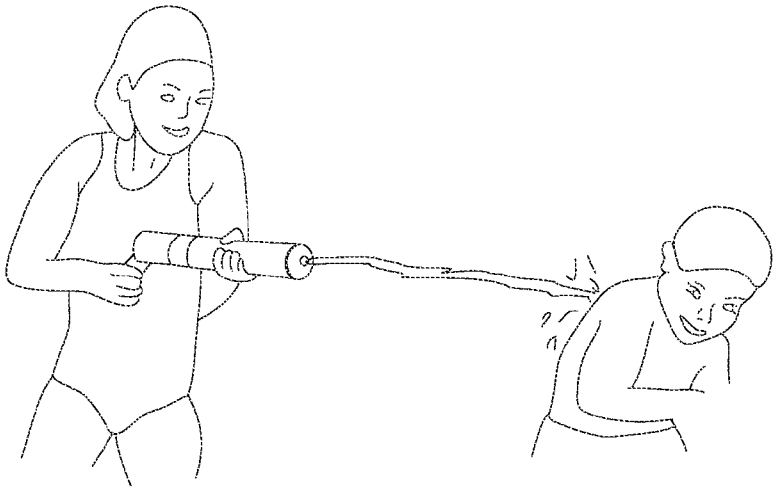
FIG. 13 is a schematic drawing showing water shooting of an embodiment in use according to the present invention.
Figure 14:
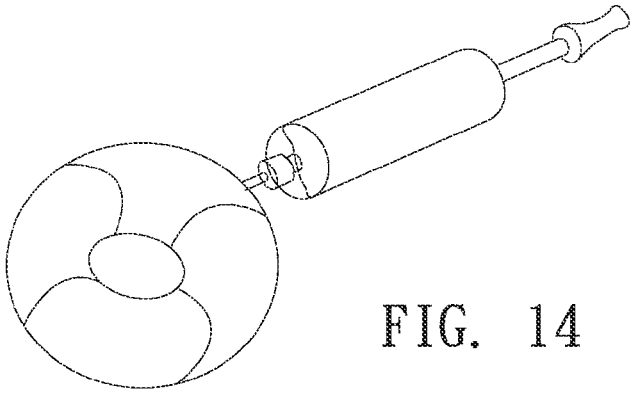
FIG. 14 is a schematic drawing showing an embodiment used for inflating a ball with an inflating needle according to the present invention.
Figure 15:
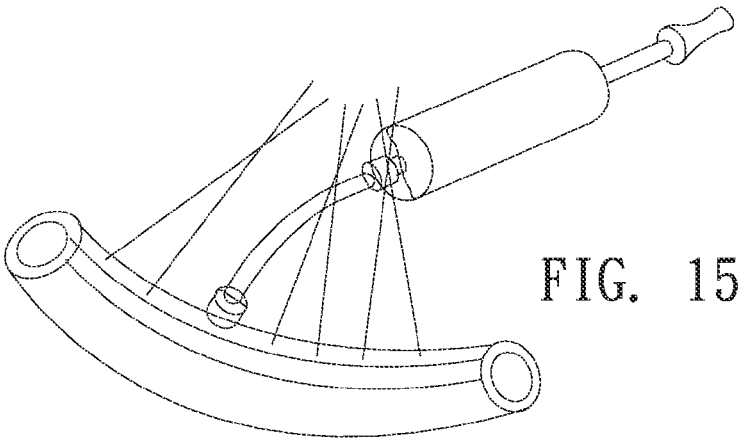
FIG. 15 is a schematic drawing showing an embodiment connected to a bike pump hose while in use according to the present invention.

Refer from FIG. 3 to FIG. 6, a jetting outlet 134 is disposed on the front plate 13 while at least one suction inlet 131 is arranged around the jetting outlet 134. The number of the suction inlet 131 is not limited. In this embodiment, there is only one suction inlet 131. As shown in FIG. 9, another embodiment of the present invention includes two suction inlets 131. Refer from FIG. 10 and FIG. 11, there are six suction inlets 131 arranged at the front plate 13. A non-return valve 132 is disposed on an inner face of the suction inlet 131 that is facing an inner space 101 of the barrel 10. The suction inlet 131 is covered by the non-return valve 132 in an opened or closed state for control of the water only able to enter the inner space 101 of the barrel 10 through the suction inlet 131 in a one-way manner, without being discharged.

Figure 7:
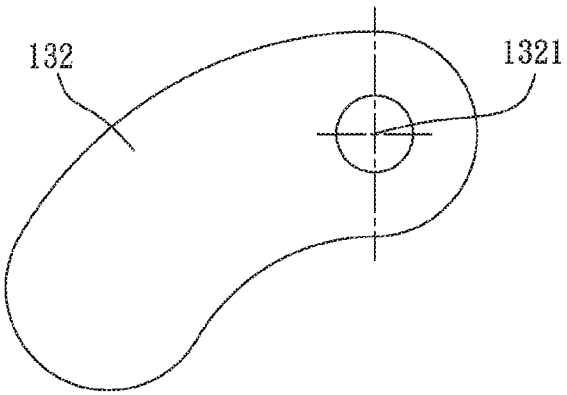
FIG. 7 is a front view of an embodiment of a non-return valve according to the present invention.
Figure 8:
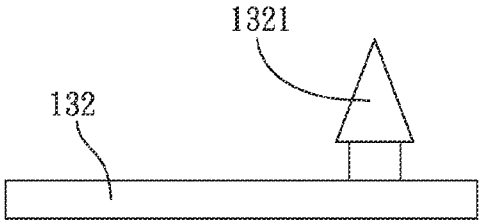
FIG. 8 is a side view of the embodiment in FIG. 7 according to the present invention.
Figure 12:
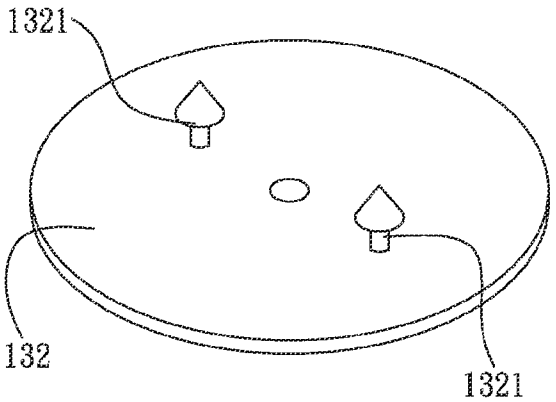
FIG. 12 is a perspective view of a non-return valve of an embodiment according to the present invention.

The material for the non-return valve 132 is not limited. The material can be metal or plastic. Refer to FIG. 7 and FIG. 8, the non-return valve 132 is a plastic plate having a certain thickness and disposed with a connection pin 1321 on one end thereof. The connection pin 1321 is mounted into a fixing hole 133 on the front plate 13 so that the non-return valve 132 is positioned on the front plate 13 and is in a closed or opened state in relation to the suction inlet 131. Moreover, the shape of the non-return valve 132 and the way of the non-return valve 132 fixed on the front plate 13 are not limited. The non-return valve 132 can be arranged with one connection pin 1321 for closing a suction inlet 131, as shown in FIG. 5 to FIG. 8. Refer to FIG. 9, the non-return valve 132 can be set with one connection pin 1321 for closing two suction inlets 131 at the same time. Refer from FIG. 10 to FIG. 12, the non-return valve 132 can also be disposed with two connection pins 1321 for closing a plurality of (six) suction inlets 131.

Refer to FIG. 2, the non-return valve 132 is opened in relation to the suction inlet 131 due to a suction force when the hand grip 20 is pulled out. Thus water outside the water gun is sucked into the inner space 101 of the water gun through the suction inlet 131 and the jetting outlet 134.

Figure 16:
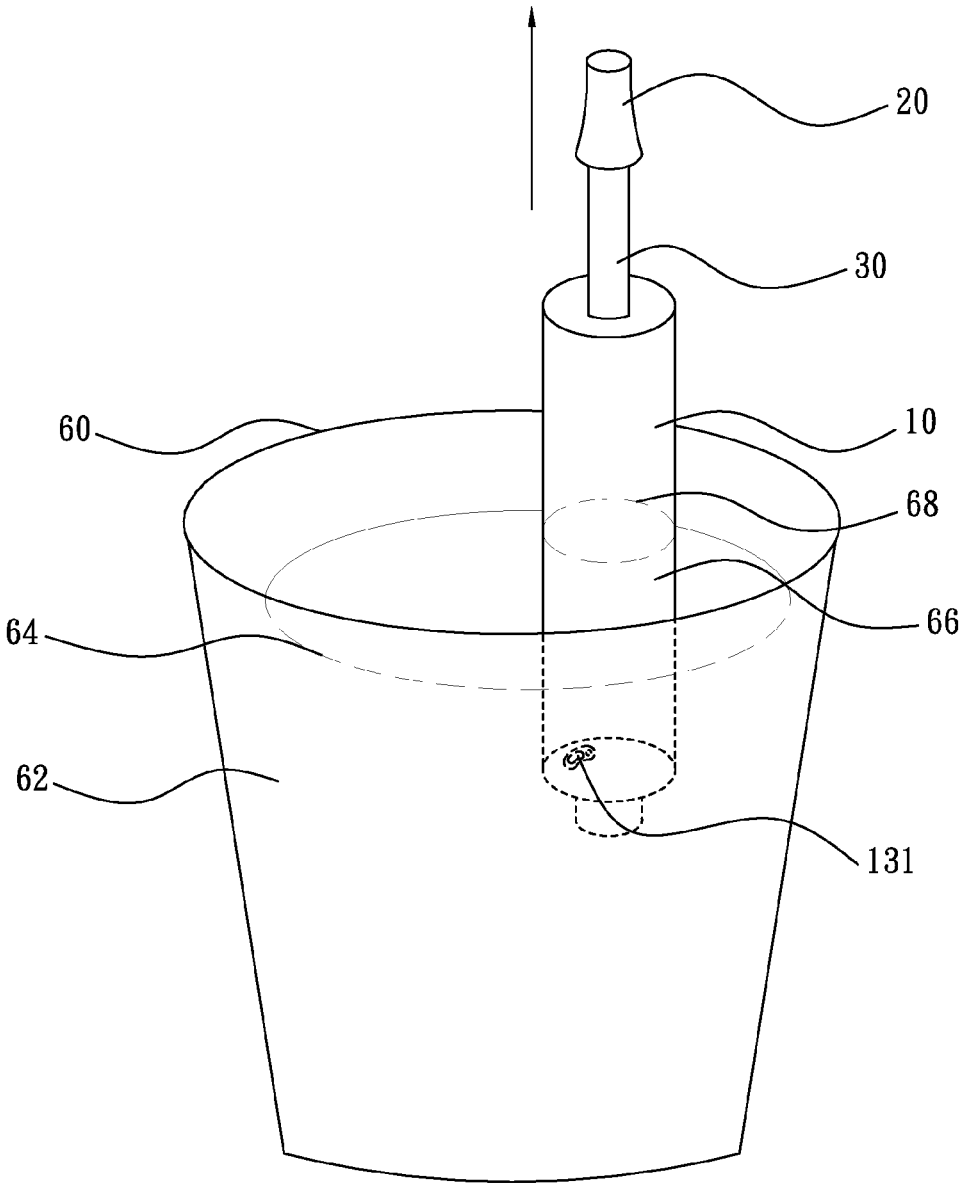
FIG. 16 is a drawing showing the water gun according to the present invention being filled using outside water being sucked into the inner space of the barrel.

FIG. 16 shows one example of outside water being sucked into the inner space of the barrel. A bucket 60, filled with water 62, having a surface 64 is provided. The water gun with the barrel 10, shaft 30 and hand grip 20 is inserted into the bucket of water so that the front end of the water gun is below the surface 64 of the water. When the hand grip 20 is moved upwardly in the direction of the arrow, suction is created in the barrel and water from the bucket enters the barrel through the suction inlet 131, which is open. This water 66 in the inner space has a surface 68, which may be above the surface 64 of the outer water. When the hand grip no longer moves upwardly, the suction inlet 131 closes and the water gun may be removed from the bucket to be used.

Now the jetting outlet 134 has functions of water suction and water jetting. When the hand grip 20 is pushed in, the inner space 101 is compressed by the cylinder valve 301. Thus the non-return valve 132 is closed in relation to the suction inlet 131 due to the pressure of the air. At the moment, the water stored in the inner space 101 is shot out through the jetting outlet 134. In this embodiment, a diameter of the suction inlet 131 can be designed to be a multiple times of a diameter of the jetting outlet 134. Thus water is drawn into the water gun rapidly through the at least one suction inlet 131. While shooting water, the water is shot further for a longer time due to the one jetting outlet 134 with a much smaller diameter. Therefore the present invention features on at least one suction inlet 131 and the jetting outlet 134 designed for water suction and water shooting respectively.

Refer from FIG. 1 to FIG. 4, an inner thread 135 is set on a projecting portion to form a threaded insert, located just outside the jetting outlet 134. The inner thread 135 can be engaged with an outer thread of a ball inflating needle 40 and/or a bike pump hose 50. Since air and water are both fluids, reacting the same way. The water gun of the present invention can also be applied to inflation of inflatable toys, balls and bike tires. This is another feature of the present invention.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A water gun comprising:

a barrel having a cylindrical inner space, a front plate disposed with a jetting outlet, and a rear plate, a hand grip disposed on a rear end of a shaft which is passed through a center of the rear plate of the barrel; and a cylinder valve arranged at a front end of the shaft and slideable airtightly in the cylindrical inner space of the barrel; wherein water outside is drawn into the cylindrical inner space through the jetting outlet when the hand grip is pulled out; wherein the cylindrical inner space is pressed by the cylinder valve so that water in the cylindrical inner space is sprayed out through the jetting outlet when the handle grip is pushed in;

wherein at least one suction inlet that works in a one-way manner is disposed around the jetting outlet;

wherein the water outside is sucked into the cylindrical inner space of the barrel through the at least one suction inlet when the hand grip is pulled out;

wherein the water in the cylindrical inner space of the barrel is unable to flow out through the at least one suction inlet when the hand grip is pushed in.

2. The device as claimed in claim 1, wherein a non-return valve is disposed on an inner face of the at least one suction inlet that is facing the cylindrical inner space of the barrel so that the at least one suction inlet is covered by the non-return valve in an opened or closed state; the non-return valve is in the opened state in relation to the at least one suction inlet due to a suction force and the water outside is sucked into the cylindrical inner space through the at least one suction inlet when the hand grip is pulled out; the cylindrical inner space is compressed by the cylinder valve so that the non-return valve is in the closed state in relation to the at least one suction inlet due to air pressure and water in the cylindrical inner space is unable to flow out through the at least one suction inlet when the hand grip is pushed in.

3. The device as claimed in claim 2, wherein the non-return valve is disposed with at least one connection pin; the at least one connection pin is fit into a fixing hole arranged at the front plate so that the non-return valve is positioned on the front plate and is in the closed state or the opened state in relation to the at least one suction inlet.

4. The device as claimed in claim 3, wherein the at least one connection pin is selected from the group consisting of one connection pin for closing one suction inlet, one connection pin for closing two suction inlets and two connection pins for closing a plurality of suction inlets.

5. The device as claimed in claim 1, wherein an inner thread is set on a projecting portion located just outside the jetting outlet; the inner thread is able to be engaged with an outer thread of a ball inflating needle or a bike pump hose.

* * * * *